US010876194B2

(12) United States Patent
Ishigaki et al.

(10) Patent No.: US 10,876,194 B2
(45) Date of Patent: Dec. 29, 2020

(54) METAL STRIP STABILIZATION APPARATUS AND METHOD FOR MANUFACTURING HOT-DIP COATED METAL STRIP USING SAME

(71) Applicant: JFE STEEL CORPORATION, Tokyo (JP)

(72) Inventors: Yusuke Ishigaki, Tokyo (JP); Yoshiaki Nishina, Tokyo (JP); Kyohei Ishida, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 110 days.

(21) Appl. No.: 15/524,793

(22) PCT Filed: Sep. 30, 2015

(86) PCT No.: PCT/JP2015/077773
§ 371 (c)(1),
(2) Date: May 5, 2017

(87) PCT Pub. No.: WO2016/080083
PCT Pub. Date: May 26, 2016

(65) Prior Publication Data

US 2017/0327936 A1 Nov. 16, 2017

(30) Foreign Application Priority Data

Nov. 20, 2014 (WO) ..... PCT/JP2014/080751

(51) Int. Cl.
*B65H 23/188* (2006.01)
*C23C 2/20* (2006.01)
(Continued)

(52) U.S. Cl.
CPC ..... *C23C 2/04* (2013.01); *B05D 1/18* (2013.01); *B05D 3/007* (2013.01); *B05D 3/04* (2013.01);
(Continued)

(58) Field of Classification Search
CPC ..... B65H 23/188; B65H 2601/524; B65H 2701/173; C23C 2/003; C23C 2/04; C23C 2/20
See application file for complete search history.

(56) References Cited

U.S. PATENT DOCUMENTS 6,309,483 B1 10/2001 Wang et al.
6,471,153 B1 * 10/2002 Kimura ..... B21B 37/007 226/15
2003/0077397 A1 4/2003 Kabeya et al.

FOREIGN PATENT DOCUMENTS

CN 1202538 A 12/1998
CN 1275448 A 12/2000
(Continued)

OTHER PUBLICATIONS

International Search Report and Written Opinion for International Application No. PCT/JP2015/077773, dated Nov. 10, 2015, 7 Pages.
(Continued)

*Primary Examiner* — Alexander M Weddle
(74) *Attorney, Agent, or Firm* — RatnerPrestia

(57) ABSTRACT

A metal strip stabilization apparatus includes: a displacement measurement unit configured to measure a displacement of a metal strip during traveling in a non-contact manner; a control unit configured to generate a vibration suppression signal and a position correction signal based on a measurement signal; and an electromagnet unit including: a vibration suppression coil configured to generate a first magnetic force based on the vibration suppression signal; a position correction coil configured to generate a second magnetic force based on the position correction signal; and a core about which the vibration suppression coil and the
(Continued)

position correction coil are wound concentrically, the core leading the first magnetic force.

10 Claims, 8 Drawing Sheets

(51) Int. Cl.

| | |
|---|---|
| ***C23C 2/04*** | (2006.01) |
| ***C23C 2/00*** | (2006.01) |
| ***B05D 1/18*** | (2006.01) |
| ***B05D 3/00*** | (2006.01) |
| ***B05D 3/04*** | (2006.01) |
| ***B05D 3/12*** | (2006.01) |
| ***B05D 7/14*** | (2006.01) |
| ***C23C 2/14*** | (2006.01) |
| ***C23C 2/18*** | (2006.01) |
| ***C23C 2/16*** | (2006.01) |

(52) U.S. Cl.
CPC ..... *B05D 3/12* (2013.01); *B05D 7/14* (2013.01); *B65H 23/188* (2013.01); *C23C 2/003* (2013.01); *C23C 2/14* (2013.01); *C23C 2/16* (2013.01); *C23C 2/18* (2013.01); *C23C 2/20* (2013.01); *B05D 2202/00* (2013.01); *B65H 2601/524* (2013.01); *B65H 2701/173* (2013.01)

(56) References Cited

FOREIGN PATENT DOCUMENTS

| | | | | |
|---|---|---|---|---|
| CN | 1279296 | A | 1/2001 | |
| CN | 1501985 | A | 6/2004 | |
| CN | 103717778 | A | 4/2014 | |
| EP | 0855450 | A1 | 7/1998 | |
| EP | 2743368 | A1 | 6/2014 | |
| JP | 0262355 | A | 3/1990 | |
| JP | 05245521 | A | 9/1993 | |
| JP | 0572854 | U | 10/1993 | |
| JP | 2004124191 | A | 4/2004 | |
| WO | 2013022004 | A1 | 2/2013 | |
| WO | WO-2013022004 | A1 * | 2/2013 | ..... B65H 23/00 |

OTHER PUBLICATIONS

Chinese Office Action for Chinese Application 201580062772.0, dated Jan. 17, 2018 with concise statement of relevence, 8 pages.
Extended European Search Report for European Application No. 15861742.3, dated Aug. 1, 2017, 7 pages.

* cited by examiner

METAL STRIP STABILIZATION APPARATUS AND METHOD FOR MANUFACTURING HOT-DIP COATED METAL STRIP USING SAME

CROSS REFERENCE TO RELATED APPLICATIONS

This is the U.S. National Phase application of PCT/JP2015/077773, filed Sep. 30, 2015, which claims priority to Application No. PCT/JP2014/080751, filed Nov. 20, 2014, the disclosures of each of these applications being incorporated herein by reference in their entireties for all purposes.

TECHNICAL FIELD OF THE INVENTION

The present invention relates a metal strip stabilization apparatus and a method for manufacturing a hot-dip coated metal strip using the same.

BACKGROUND OF THE INVENTION

In a manufacturing line for manufacturing a metal strip, maintaining a traveling route (hereinafter, referred to as a pass line) of the metal strip stably by suppressing vibration, warp, or the like of the metal strip during traveling contributes not only to improving a quality of the manufactured metal strip but also to improving efficiency of the manufacturing line of the metal strip.

For example, a hot-dip coated metal strip manufacturing line includes a step of coating front and back surfaces of the metal strip with a molten metal by passing the metal strip while the metal strip is immersed in a molten metal bath. Due to this step, an excessive portion of the molten metal coating the metal strip is wiped by a wiping gas ejected from a gas wiper provided in a subsequent stage of the molten metal bath. This adjusts the coating amount of the molten metal on the surfaces of the metal strip. Such an adjustment of the coating amount of the molten metal on the surfaces of the metal strip (hereinafter, abbreviated as "adjustment of coating amount of molten metal") is performed in order to suppress generation of unevenness in the coating amount of the molten metal on the metal strip.

In the above adjustment of the coating amount of the molten metal, it is necessary to eject a wiping gas from a gas wiper to front and back surfaces of the metal strip during traveling such that a pressure is applied uniformly in a width direction of the metal strip. However, when a distance between the gas wiper and the metal strip is not constant, for example, when the metal strip is vibrating, the metal strip is warped, or a pass line of the metal strip is biased to either a front surface or a back surface of the metal strip, a pressure of a wiping gas applied to the metal strip is not uniform in a width direction of the metal strip and a passing direction thereof. As a result, unevenness in the coating amount of a molten metal is generated disadvantageously on a front surface of the metal strip, a back surface thereof, or both the front surface and the back surface thereof in a width direction of the metal strip and a passing direction thereof.

As a method for solving such a problem, a technology for suppressing warp or vibration of a metal strip using an electromagnet in a non-contact manner and stabilizing a pass line of the metal strip is known. For example, there is prior art that a pair of electromagnets is disposed so as to face each other with a traveling surface on which a metal strip travels interposed therebetween, and an attractive force of each of the electromagnets is caused to act on the metal strip while being switched to each other according to a signal from a position detector separately provided (refer to Patent Literature 1).

As described above, when a pass line of a metal strip is stabilized using an electromagnet, response of the electromagnet is required for vibration suppression of the metal strip, and an attractive force of the electromagnet is required for position correction of the metal strip. Here, position correction of the metal strip means combination of warp correction of the metal strip and pass line correction thereof. In general, response of an electromagnet is improved as the number of turns of a coil in an electromagnet is reduced. However, when the number of turns of a coil is reduced in order to improve response of an electromagnet, an attractive force of the electromagnet is reduced. On the contrary, an attractive force of an electromagnet is increased as the number of turns of a coil in the electromagnet is increased. However, when the number of turns of a coil is increased in order to increase an attractive force of an electromagnet, response of the electromagnet is deteriorated. That is, in order to achieve vibration suppression of a metal strip and position correction thereof using an electromagnet simultaneously, contradictory properties of response of the electromagnet and an attractive force thereof are required, as described above.

In order to solve this problem, for example, a technology for controlling a pass line of a metal strip in a non-contact manner using an electromagnet including two independent lines of coils for vibration suppression and position correction has been proposed (refer to Patent Literature 2). In prior art described in Patent Literature 2, two lines of a vibration suppression coil and a position correction coil are wound about a core of an electromagnet, vibration suppression of a metal strip is performed by a magnetic force from the vibration suppression coil having a relatively small number of turns, and position correction of the metal strip is performed by a magnetic force from the position correction coil having a larger number of turns than the vibration suppression coil.

PATENT LITERATURE

Patent Literature 1: Japanese Laid-open Patent Publication No. 2-62355

Patent Literature 2: Japanese Laid-open Patent Publication No. 2004-124191

SUMMARY OF THE INVENTION

In the above prior art, due to mutual induction between the two independent lines of the vibration suppression coil and the position correction coil, a vibration suppression ability of a metal strip may be reduced excessively by a magnetic force from the vibration suppression coil. As a result, it is difficult to achieve a required vibration suppression ability of a metal strip.

In addition, due to restriction of installation space for an electromagnet, restriction of heat generation, or the like, the total number of turns of the vibration suppression coil and the position correction coil wound about a core of the electromagnet is restricted. Therefore, some ratios between the number of turns of the vibration suppression coil and the number of turns of the position correction coil, having a restriction of the total number of turns may make it impossible for the vibration suppression coil to apply an attractive force required for vibration suppression of a metal strip, and in addition, may make it impossible for the position correction coil to apply an attractive force required for position correction of the metal strip. As a result, it is difficult to achieve a required position correction ability of a metal strip in addition to the above vibration suppression ability of the metal strip.

The present invention has been achieved in view of the above circumstances, and an object thereof is to provide a metal strip stabilization apparatus capable of achieving a required vibration suppression ability of a metal strip and a required position correction ability thereof simultaneously such that the metal strip travels stably, and a method for manufacturing a hot-dip coated metal strip using the metal strip stabilization apparatus.

To solve the above-described problem and achieve the object, a metal strip stabilization apparatus according to an aspect of the present invention includes: a displacement measurement unit configured to measure a displacement of a metal strip during traveling in a non-contact manner; a control unit configured to generate a vibration suppression signal for controlling vibration suppression of the metal strip and a position correction signal for controlling position correction of the metal strip based on a measurement signal of a displacement of the metal strip by the displacement measurement unit; and an electromagnet unit including: a vibration suppression coil configured to generate a first magnetic force based on the vibration suppression signal by the control unit; a position correction coil configured to generate a second magnetic force based on the position correction signal by the control unit; and a core about which the vibration suppression coil and the position correction coil are wound concentrically, the core leading the first magnetic force and the second magnetic force to the metal strip, the electromagnet unit being configured to suppress vibration of the metal strip by the first magnetic force, and correct a position of the metal strip by the second magnetic force, wherein the number of turns of the position correction coil is twice to five times of the number of turns of the vibration suppression coil.

Moreover, in the above-described metal strip stabilization apparatus according to an aspect of the present invention, the electromagnet unit includes: a front surface side electromagnet configured to suppress vibration of the metal strip by the first magnetic force and correct a position of the metal strip by the second magnetic force from a front surface side of the metal strip; and a back surface side electromagnet configured to suppress vibration of the metal strip by the first magnetic force and correct a position of the metal strip by the second magnetic force from a back surface side of the metal strip.

Moreover, in the above-described metal strip stabilization apparatus according to an aspect of the present invention, the front surface side electromagnet and the back surface side electromagnet face each other with the metal strip interposed therebetween.

Moreover, in the above-described metal strip stabilization apparatus according to an aspect of the present invention, a plurality of the front surface side electromagnets and a plurality of the back surface side electromagnets are disposed so as to be arranged in a width direction of the metal strip.

Moreover, a method for manufacturing a hot-dip coated metal strip according to an apsect of the present invention includes: a coating step of coating a metal strip with a molten metal during traveling along a manufacturing line; an adjustment step of adjusting the coating amount of the molten metal in the metal strip by wiping an excessive portion of the molten metal coating the metal strip by a gas wiper; and a control step of controlling vibration of the metal strip and a position thereof in a non-contact manner by any one of the above-described metal strip stabilization apparatus.

The present invention exhibits an effect that a required vibration suppression ability of a metal strip and a required position correction ability thereof can be achieved simultaneously such that the metal strip travels stably.

DETAILED DESCRIPTION OF EMBODIMENTS OF THE INVENTION

Figure 1:
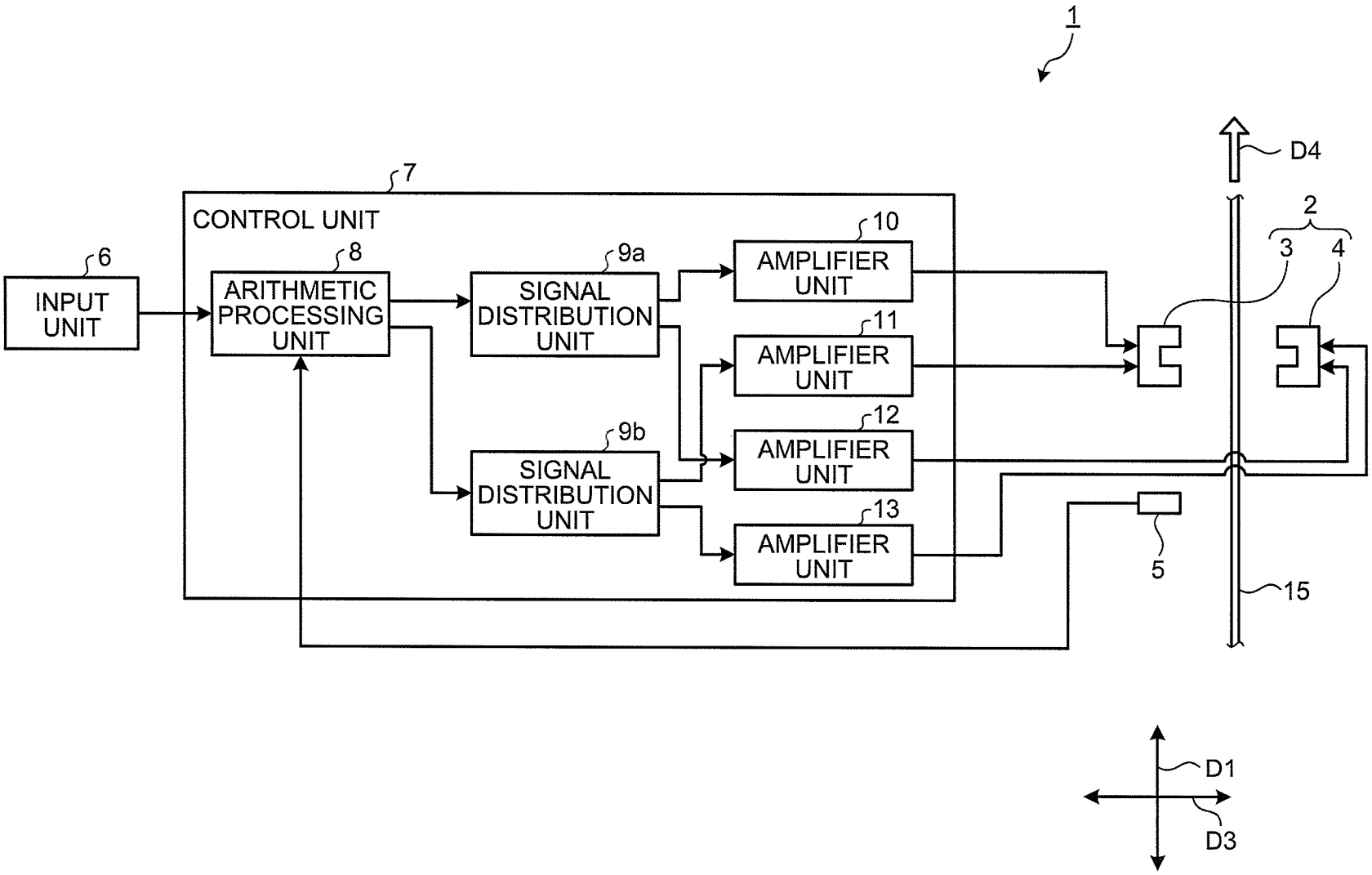
FIG. 1 is a diagram illustrating a configuration example of a metal strip stabilization apparatus according to an embodiment of the present invention.

Hereinafter, a preferable embodiment of a metal strip stabilization apparatus according the present invention and a method for manufacturing a hot-dip coated metal strip using the metal strip stabilization apparatus will be described in detail with reference to the attached drawings. Note that the present invention is not limited by the present embodiment. The drawings are schematic, and it should be noted that a relationship between sizes of the elements, a ratio between the elements, and the like may be different from actual ones. The drawings may include portions in which a relationship between sizes or a ratio may be different from one another. In the drawings, the same reference sign is given to the same component.

(Configuration of Metal Strip Stabilization Apparatus)

FIG. 1 is a diagram illustrating a configuration example of a metal strip stabilization apparatus according to an embodiment of the present invention. As illustrated in FIG. 1, a metal strip stabilization apparatus 1 according to an embodiment of the present invention includes an electromagnet unit 2 for causing a magnetic force for vibration suppression and position correction to act on a metal strip 15 during traveling, a displacement measurement unit 5 for measuring a displacement of the metal strip 15 during traveling in a non-contact manner, an input unit 6 for inputting necessary information, and a control unit 7 for controlling the electromagnet unit 2 based on an input signal from the displacement measurement unit 5.

The electromagnet unit 2 performs vibration suppression and position correction for the metal strip 15 traveling in a traveling direction D4 illustrated in FIG. 1 by a magnetic force. In the present embodiment, as illustrated in FIG. 1, the electromagnet unit 2 is constituted by a front surface side electromagnet group 3 disposed on a front surface side of the metal strip 15 and a back surface side electromagnet group 4 disposed on a back surface side of the metal strip 15.

The front surface side electromagnet group 3 causes a magnetic force for vibration suppression of the metal strip 15 (hereinafter, appropriately referred to as vibration suppression magnetic force) and a position correction magnetic force of the metal strip 15 (hereinafter, appropriately referred to as position correction magnetic force) to act on the front surface side of the metal strip 15 during traveling. Therefore, the front surface side electromagnet group 3 suppresses vibration of the metal strip 15 during traveling by the vibration suppression magnetic force, and corrects a position of the metal strip 15 during traveling by the position correction magnetic force from the front surface side of the metal strip 15. The back surface side electromagnet group 4 causes the vibration suppression magnetic force and the position correction magnetic force to act on the back surface side of the metal strip 15 during traveling. Therefore, the back surface side electromagnet group 4 suppresses vibration of the metal strip 15 during traveling by the vibration suppression magnetic force, and corrects a position of the metal strip 15 during traveling by the position correction magnetic force from the back surface side of the metal strip 15. The electromagnet unit 2 constituted by the front surface side electromagnet group 3 and the back surface side electromagnet group 4 suppresses vibration of the metal strip 15 during traveling by the vibration suppression magnetic force, and corrects a position of the metal strip 15 during traveling by the position correction magnetic force from the front and back surface sides of the metal strip 15.

Each electromagnet of the front surface side electromagnet group 3 and the back surface side electromagnet group 4, that is, each electromagnet constituting the electromagnet unit 2 includes a vibration suppression coil for generating a vibration suppression magnetic force based on a vibration suppression signal provided by the control unit 7 and a position correction coil for generating a position correction magnetic force based on a position correction signal provided by the control unit 7, as described below. The two independent lines of coils for vibration suppression and position correction are wound concentrically about each electromagnet constituting the electromagnet unit 2, and each electromagnet includes a core leading the vibration suppression magnetic force and the position correction magnetic force to the metal strip 15.

Figure 2:
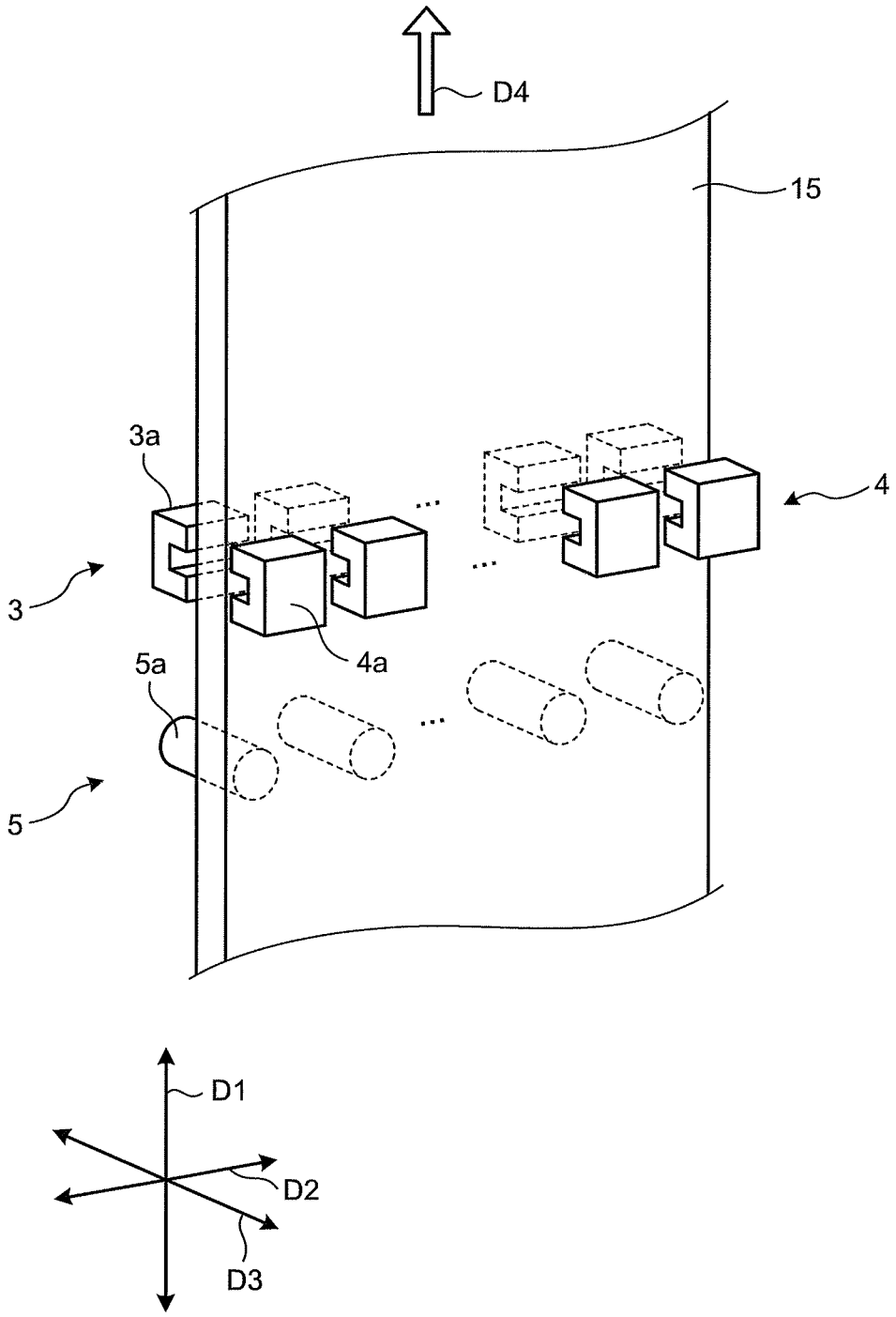
FIG. 2 is a view illustrating an example of disposition of an electromagnet in the metal strip stabilization apparatus according to an embodiment of the present invention.

FIG. 2 is a view illustrating an example of disposition of an electromagnet in the metal strip stabilization apparatus according to an embodiment of the present invention. Note that FIG. 2 also illustrates an example of disposition of the displacement measurement unit 5 described below. As illustrated in FIG. 2, the front surface side electromagnet group 3 is an assembly of electromagnets 3*a* functioning as a front surface side electromagnet for performing vibration suppression and position correction for the metal strip 15 from the front surface side of the metal strip 15. That is, each of the electromagnets 3*a* constituting the front surface side electromagnet group 3 suppresses vibration of the metal strip 15 during traveling by the vibration suppression magnetic force based on the vibration suppression signal provided by the control unit 7, and corrects a position of the metal strip 15 during traveling by the position correction magnetic force based on the position correction signal provided by the control unit 7 from the front surface side of the metal strip 15. On the other hand, the back surface side electromagnet group 4 is an assembly of electromagnets 4*a* functioning as a back surface side electromagnet for performing vibration suppression and position correction for the metal strip 15 from the back surface side of the metal strip 15. That is, each of the electromagnets 4*a* constituting the back surface side electromagnet group 4 suppresses vibration of the metal strip 15 during traveling by the vibration suppression magnetic force based on the vibration suppression signal provided by the control unit 7, and corrects a position of the metal strip 15 during traveling by the position correction magnetic force based on the position correction signal provided by the control unit 7 from the back surface side of the metal strip 15.

As illustrated in FIG. 2, the plurality of electromagnets 3*a* of the front surface side electromagnet group 3 and the plurality of electromagnets 4*a* of the back surface side electromagnet group 4 are disposed so as to be arranged in a width direction D2 of the metal strip 15 on the front surface side of the metal strip 15 and the back surface side thereof, respectively. As illustrated in FIG. 1, the front surface side electromagnet group 3 and the back surface side electromagnet group 4 are disposed so as to face each other with the metal strip 15 interposed therebetween with a predetermined gap in a thickness direction D3 of the metal strip 15. In this disposition, for example, as illustrated in FIG. 2, the electromagnets 3*a* of the front surface side electromagnet group 3 and the electromagnets 4*a* of the back surface side electromagnet group 4 face each other with the metal strip 15 interposed therebetween.

In the present embodiment, the width direction D2 of the metal strip 15 is a direction perpendicular to a longitudinal direction D1 of the metal strip 15 and the thickness direction D3 thereof. The traveling direction D4 of the metal strip 15 is a direction parallel to the longitudinal direction D1 of the metal strip 15.

On the other hand, the displacement measurement unit 5 measures a displacement of the metal strip 15 during traveling in a non-contact manner, and is disposed near the above electromagnet unit 2. Specifically, as illustrated in FIG. 1, the displacement measurement unit 5 is disposed near the front surface side electromagnet group 3 of the electromagnet unit 2 on an upstream side of the front surface side electromagnet group 3 in the traveling direction D4 of the metal strip 15. The displacement measurement unit 5 sequentially measures a displacement of the metal strip 15 from a reference traveling route, caused by vibration of the metal strip 15 during traveling, warp thereof, fluctuation of a pass line, or the like continuously or intermittently at every predetermined interval by a measurement method in a non-contact manner. At each measurement time, the displacement measurement unit 5 transmits a measurement signal indicating an obtained measurement value of the displacement of the metal strip 15 to the control unit 7. In the present embodiment, the reference traveling route of the metal strip 15 is a reference traveling route on which the metal strip 15 should travel. For example, the reference traveling route of the metal strip 15 is set in the middle of the front surface side electromagnet group 3 and the back surface side electromagnet group 4 facing each other in the electromagnet unit 2 illustrated in FIG. 1.

In the present embodiment, the displacement measurement unit 5 is an assembly of non-contact displacement sensors 5*a* (refer to FIG. 2) disposed with a necessary gap from the metal strip 15. As illustrated in FIG. 2, the plurality of non-contact displacement sensors 5*a* is disposed so as to be arranged in the width direction D2 of the metal strip 15 while each of the non-contact displacement sensors 5*a* is constituted by using an eddy current displacement sensor or the like. The plurality of non-contact displacement sensors 5*a* sequentially measures a displacement from the reference traveling route of the metal strip 15 at each position in the width direction D2 of the metal strip 15 near each of the electromagnets 3*a* of the front surface side electromagnet group 3 and each of the electromagnets 4*a* of the back surface side electromagnet group 4 in a non-contact manner. The displacement measurement unit 5 transmits each measurement signal indicating a measurement value of a displacement of the metal strip 15 measured at each position in the width direction D2 by the plurality of non-contact displacement sensors 5*a* to the control unit 7.

The input unit 6 is constituted by using an input device such as an input key, and inputs information required for controlling vibration suppression and position correction for the metal strip 15 to the control unit 7. Examples of the information input to the control unit 7 by the input unit 6 include a target value of a displacement of the metal strip 15 during traveling (specifically, a displacement from a reference traveling route).

The control unit 7 generates a vibration suppression signal for controlling vibration suppression of the metal strip 15 and a position correction signal for controlling position correction of the metal strip 15 based on a measurement signal of a displacement of the metal strip 15, provided by the displacement measurement unit 5. The control unit 7 controls the electromagnet unit 2 for performing vibration suppression and position correction for the metal strip 15 during traveling using the generated vibration suppression signal and position correction signal.

Specifically, as illustrated in FIG. 1, the control unit 7 includes an arithmetic processing unit 8 for generating a vibration suppression signal and a position correction signal, signal distribution units 9*a* and 9*b* for distributing the vibration suppression signal and the position correction signal according to an output destination, and amplifier units 10 to 13 for supplying power to the electromagnet unit 2 based on the vibration suppression signal or the position correction signal.

The arithmetic processing unit 8 generates the vibration suppression signal for vibration suppression of the metal strip 15 and the position correction signal for position correction of the metal strip 15 based on a measurement signal of a displacement of the metal strip 15, provided by the displacement measurement unit 5. Specifically, the arithmetic processing unit 8 acquires input information indicating a target value of a displacement of the metal strip 15 from the input unit 6, and sets the target value of a displacement of the metal strip 15 during traveling based on the acquired input information in advance. The arithmetic processing unit 8 acquires a measurement signal of a displacement of the metal strip 15 during traveling from each of the non-contact displacement sensors 5*a* of the displacement measurement unit 5. Subsequently, the arithmetic processing unit 8 calculates a deviation signal indicating a deviation between a measurement value of a displacement of the metal strip 15 corresponding to the acquired measurement signal and the target value set in advance. The arithmetic processing unit 8 performs arithmetic processing such as proportion, deviation, or integration, so-called PID control. The arithmetic processing unit 8 thereby generates a vibration suppression signal and a position correction signal from the measurement signal of a displacement of the metal strip 15.

In the present embodiment, in the arithmetic processing unit 8, it is assumed that arithmetic processing to generate a vibration suppression signal places importance on response of the electromagnet unit 2, and that arithmetic processing to generate a position correction signal places importance on a static magnetic attractive force of the electromagnet unit 2.

That is, the arithmetic processing unit 8 performs arithmetic processing so as to obtain a large gain of a high frequency component contained in a measurement signal input from each of the non-contact displacement sensors 5*a* of the displacement measurement unit 5 by increasing a set value of a differential gain, for example. The arithmetic processing unit 8 thereby separates and generates a vibration suppression signal mainly containing a high frequency component from this measurement signal. On the other hand, the arithmetic processing unit 8 performs arithmetic processing so as to obtain a large gain of a low frequency component contained in a measurement signal input from each of the non-contact displacement sensors 5*a* of the displacement measurement unit 5 by increasing a set value of an integration gain, for example. The arithmetic processing unit 8 thereby separates and generates a position correction signal mainly containing a low frequency component from this measurement signal. In this way, whenever a vibration suppression signal and a position correction signal are generated, the arithmetic processing unit 8 transmits the obtained vibration suppression signal and position correction signal to the signal distribution unit 9*a* for vibration suppression and the signal distribution unit 9*b* for position correction.

In the present embodiment, the high frequency and the low frequency mean the height when arithmetic processing of a vibration suppression signal is compared to arithmetic processing of a position correction signal in the arithmetic processing unit 8. According to the configuration of the arithmetic processing unit 8, the vibration suppression signal contains a high frequency component in a large amount, and the position correction signal contains a low frequency component in a large amount. This means that an average value of frequency components of the vibration suppression signal is higher than an average value of frequency components of the position correction signal, and allows an overlapping portion to be present between a frequency distribution of the vibration suppression signal and a frequency distribution of the position correction signal.

Meanwhile, the signal distribution units 9*a* and 9*b* appropriately distribute the vibration suppression signal and the position correction signal output from the arithmetic processing unit 8 to the amplifier units 10 to 13 corresponding to the electromagnets in the electromagnet unit 2. Specifically, as illustrated in FIG. 1, the signal distribution unit 9*a* distributes vibration suppression signals output from the arithmetic processing unit 8 to the amplifier unit 10 involved in generation of a vibration suppression magnetic force by the front surface side electromagnet group 3 and the amplifier unit 12 involved in generation of a vibration suppression magnetic force by the back surface side electromagnet group 4. The signal distribution unit 9*b* distributes position correction signals output from the arithmetic processing unit 8 to the amplifier unit 11 involved in generation of a position correction magnetic force by the front surface side electromagnet group 3 and the amplifier unit 13 involved in generation of a position correction magnetic force by the back surface side electromagnet group 4.

The amplifier unit 10 is constituted by a plurality of amplifiers for supplying power to a vibration suppression coil in each of the electromagnets 3*a* (refer to FIG. 2) of the front surface side electromagnet group 3. The plurality of amplifiers (not illustrated) constituting the amplifier unit 10 supplies an excitation current to a vibration suppression coil in each of the electromagnets 3*a* according to a vibration suppression signal distributed by the signal distribution unit 9*a*. The amplifier unit 10 thereby causes each of the electromagnets 3*a* to generate a vibration suppression magnetic force acting on a front surface side of the metal strip 15 appropriately.

The amplifier unit 11 is constituted by a plurality of amplifiers for supplying power to a position correction coil in each of the electromagnets 3*a* of the front surface side electromagnet group 3. The plurality of amplifiers (not illustrated) constituting the amplifier unit 11 supplies an excitation current to a position correction coil in each of the electromagnets 3*a* according to a position correction signal distributed by the signal distribution unit 9*b*. The amplifier unit 11 thereby causes each of the electromagnets 3*a* to generate a position correction magnetic force acting on a front surface side of the metal strip 15 appropriately.

The amplifier unit 12 is constituted by a plurality of amplifiers for supplying power to a vibration suppression coil in each of the electromagnets 4*a* (refer to FIG. 2) of the back surface side electromagnet group 4. The plurality of amplifiers (not illustrated) constituting the amplifier unit 12 supplies an excitation current to a vibration suppression coil in each of the electromagnets 4*a* according to a vibration suppression signal distributed by the signal distribution unit 9*a*. The amplifier unit 12 thereby causes each of the electromagnets 4*a* to generate a vibration suppression magnetic force acting on a back surface side of the metal strip 15 appropriately.

The amplifier unit 13 is constituted by a plurality of amplifiers for supplying power to a position correction coil in each of the electromagnets 4*a* of the back surface side electromagnet group 4. The plurality of amplifiers (not illustrated) constituting the amplifier unit 13 supplies an excitation current to a position correction coil in each of the electromagnets 4*a* according to a position correction signal distributed by the signal distribution unit 9*b*. The amplifier unit 13 thereby causes each of the electromagnets 4*a* to generate a position correction magnetic force acting on a back surface side of the metal strip 15 appropriately.

(Configuration of Electromagnet in Electromagnet Unit)

Figure 3:
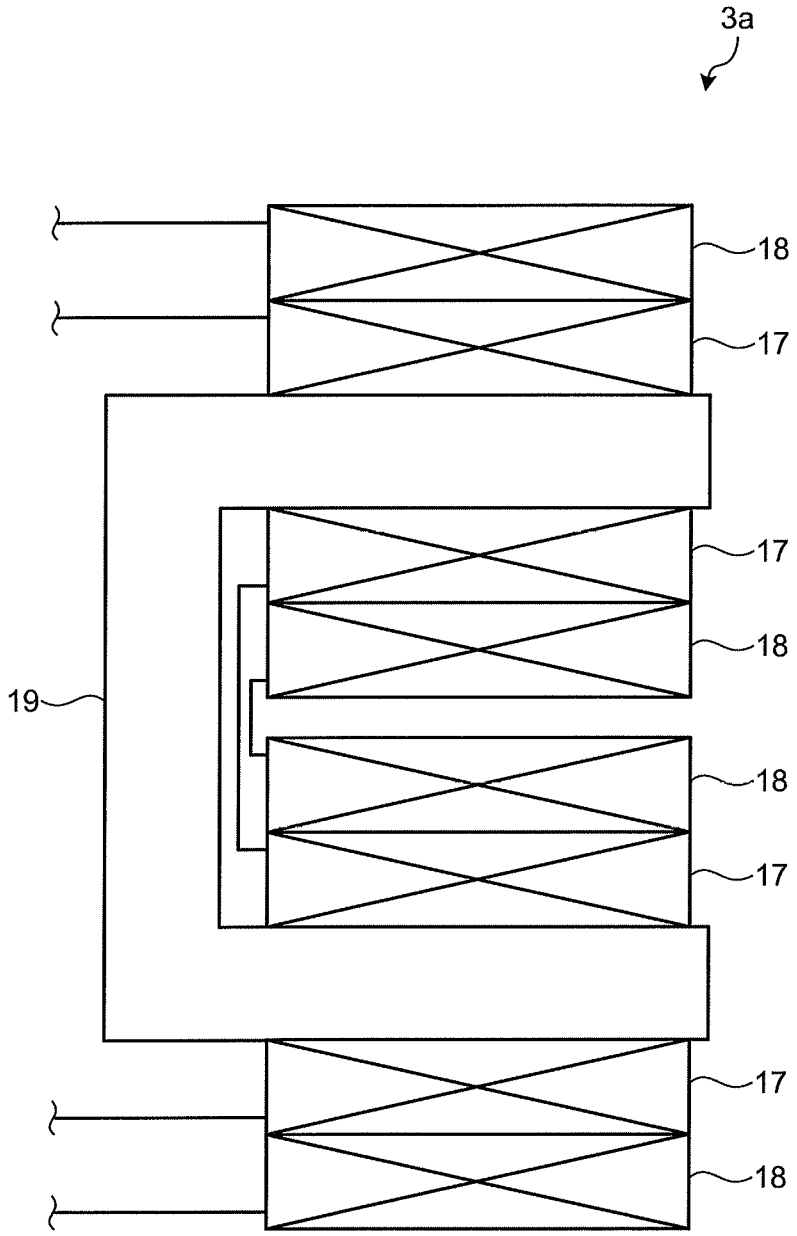
FIG. 3 is a diagram illustrating a configuration example of an electromagnet in an electromagnet unit in the metal strip stabilization apparatus according to an embodiment of the present invention.

Next, a configuration of an electromagnet in the electromagnet unit 2 as a configuration part of the metal strip stabilization apparatus 1 according to an embodiment of the present invention will be described. FIG. 3 is a diagram illustrating a configuration example of an electromagnet in an electromagnet unit in the metal strip stabilization apparatus according to an embodiment of the present invention. FIG. 3 illustrates a configuration example of the electromagnets 3*a* (refer to FIG. 2) contained in the front surface side electromagnet group 3 in the electromagnet unit 2. Hereinafter, a configuration of each of the electromagnets 3*a* in the front surface side electromagnet group 3 will be described as a representative of the electromagnet unit 2. All the electromagnets constituting the electromagnet unit 2, such as the electromagnets 4*a* of the back surface side electromagnet group 4 illustrated in FIG. 2 have a similar configuration to each of the electromagnets 3*a*.

As illustrated in FIG. 3, each of the electromagnets 3*a* includes two independent lines of a vibration suppression coil 17 and a position correction coil 18, and a core 19. The vibration suppression, coil 17 generates a vibration suppression magnetic force based on a vibration suppression signal provided by the control unit 7. The position correction coil 18 generates a position correction magnetic force based on a position correction signal provided by the control unit 7. The core 19 leads the vibration suppression magnetic force provided by the vibration suppression coil 17 and the position correction magnetic force provided by the position correction coil 18 to the metal strip 15 (refer to FIGS. 1 and 2) during traveling.

As illustrated in FIG. 3, the vibration suppression coil 17 and the position correction coil 18 are concentrically wound about each leg portion of the core 19. At this time, the number of turns of the vibration suppression coil 17 is different from that of the position correction coil 18. Specifically, the number of turns of the vibration suppression coil 17 is less than that of the position correction coil 18. In this way, the concentrical coils formed of the vibration suppression coil 17 and the position correction coil 18 are constituted in the single core 19.

In the present invention, high response to a degree capable of sufficiently following a vibration frequency of the target metal strip 15 (usually, specific frequency of the metal strip 15, such as bending or twisting) is often required for the vibration suppression coil 17. However, in order to suppress vibration of a specific frequency of the metal strip 15, a large attractive force is not required for the vibration suppression coil 17. Therefore, the number of turns of the vibration suppression coil 17 is less than that of the position correction coil 18.

Such high response as the vibration suppression coil 17 is not required for the position correction coil 18. However, when position correction of the metal strip 15 is performed by a position correction magnetic force generated by the position correction coil 18, it is desirable to suppress an excitation current supplied to the position correction coil 18 to a value as small as possible and to cause the position correction coil 18 to generate a large attractive force. Therefore, the number of turns of the position correction coil 18 is desirably as large as possible in a range in which restriction by the size of each of the electromagnets 3*a* is satisfied and an electric resistance value is not excessively large.

Conditions of the numbers of turns of the vibration suppression coil 17 and the position correction coil 18 were studied intensively. As a result, conditions of the numbers of turns capable of obtaining high response required for the vibration suppression coil 17 and a high attractive force required for the position correction coil 18 simultaneously have been found. Specifically, the number of turns of the position correction coil 18 is two times or more and five times or less the number of turns of the vibration suppression coil 17. By satisfying the conditions of the numbers of turns of the coils, it is possible to obtain response of the electromagnets 3*a* required for vibration suppression of the metal strip 15 during traveling and an attractive force of the electromagnets 3*a* required for position correction of the metal strip 15 during traveling simultaneously.

Note that in an embodiment of the present invention, an attractive force of the vibration suppression coil 17 is a force for attracting the metal strip 15 by a vibration suppression magnetic force. An attractive force of the position correction coil 18 is a force for attracting the metal strip 15 by a position correction magnetic force.

(Circuit Configuration of Electromagnet)

Figure 4:
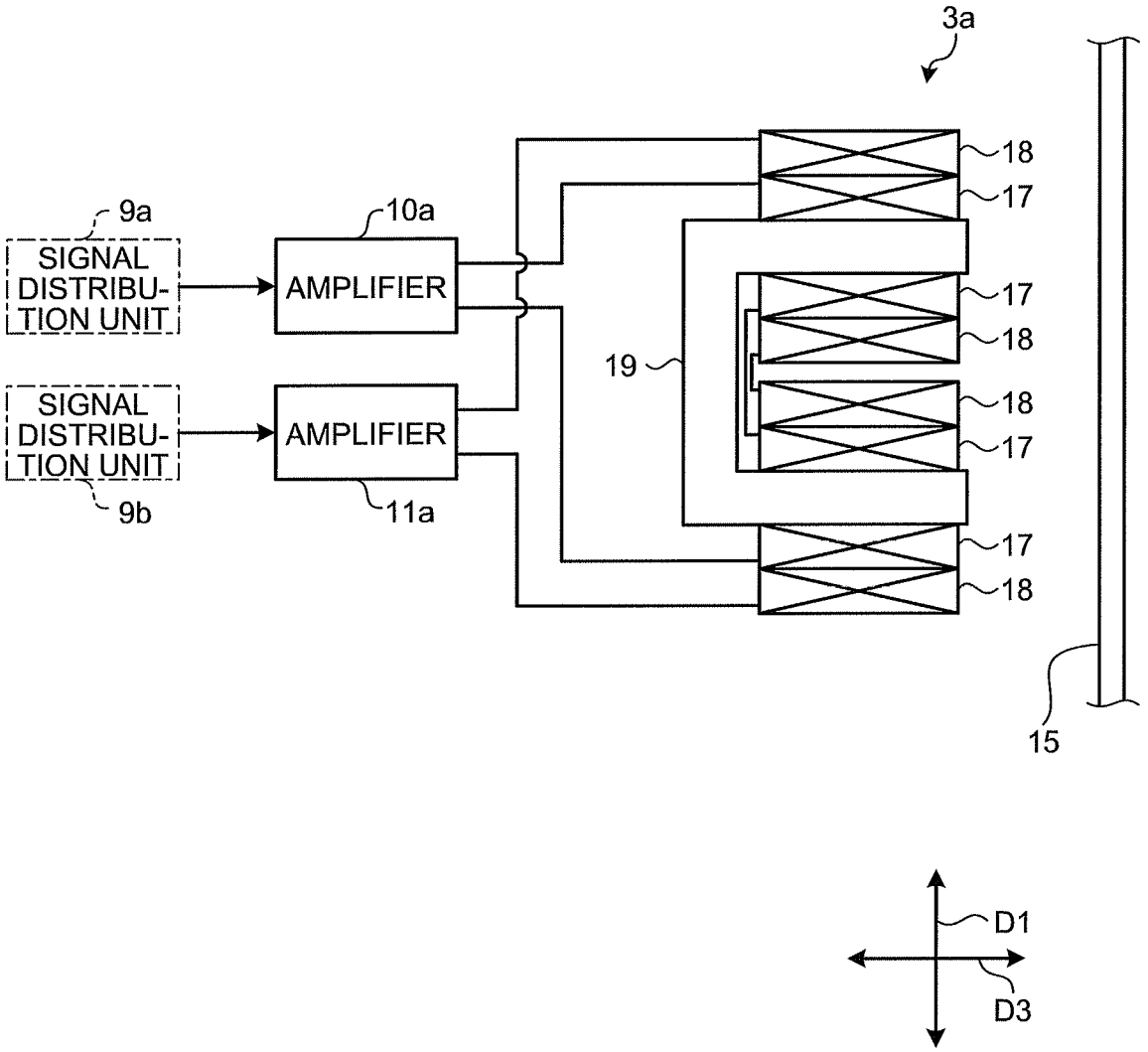
FIG. 4 is a diagram illustrating an example of a circuit configuration of an electromagnet in the metal strip stabilization apparatus according to an embodiment of the present invention.

Next, a circuit configuration of each electromagnet constituting the electromagnet unit 2 will be described. FIG. 4 is a diagram illustrating an example of a circuit configuration of an electromagnet in the metal strip stabilization apparatus according to an embodiment of the present invention. FIG. 4 illustrates an example of a circuit configuration of each of the electromagnets 3*a* (refer to FIG. 2) contained in the front surface side electromagnet group 3 in the electromagnet unit 2. Hereinafter, a circuit configuration of each of the electromagnets 3*a* in the front surface side electromagnet group 3 will be described as a representative of the electromagnet unit 2.

As illustrated in FIG. 4, the vibration suppression coil 17 and the position correction coil 18 are concentrically wound about each leg portion of the core 19 of each of the electromagnets 3*a*. In this way, the concentrical coils formed of the vibration suppression coil 17 and the position correction coil 18 are formed in each of the electromagnet 3*a*. Of the concentrical coils in each of the electromagnets 3*a*, the vibration suppression coils 17 are connected in series between the leg portions of the core 19, and are connected to an amplifier 10*a* for vibration suppression. The position correction coils 18 are connected in series between the leg portions of the core 19, and are connected to an amplifier 11*a* for position correction.

The amplifier 10*a* is one of a plurality of amplifiers constituting the amplifier unit 10 for vibration suppression, supplying power to the front surface side electromagnet group 3 illustrated in FIG. 1. The amplifier 10*a* supplies an excitation current to the vibration suppression coil 17 through an electric circuit according to a vibration suppression signal input by the signal distribution unit 9*a*. The vibration suppression coil 17 generates a vibration suppression magnetic force by power supply from the amplifier 10*a*. The core 19 leads the vibration suppression magnetic force generated by the vibration suppression coil 17 to a front surface side of the metal strip 15.

The amplifier 11*a* is one of a plurality of amplifiers constituting the amplifier unit 11 for position correction, supplying power to the front surface side electromagnet group 3 illustrated in FIG. 1. The amplifier 11*a* supplies an excitation current to the position correction coil 18 through an electric circuit according to a position correction signal input by the signal distribution unit 9*b*. The position correction coil 18 generates a position correction magnetic force by power supply from the amplifier 11*a*. The core 19 leads the position correction magnetic force generated by the position correction coil 18 to a front surface side of the metal strip 15.

Each of the electromagnets 3*a* having the above circuit configuration causes a vibration suppression magnetic force by the vibration suppression coil 17 to act on a front surface side of the metal strip 15, and thereby suppresses vibration of the metal strip 15 by the vibration suppression magnetic force from the front surface side of the metal strip 15. In addition, each of the electromagnets 3*a* causes a position correction magnetic force by the position correction coil 18 to act on a front surface side of the metal strip 15, and thereby corrects a position of the metal strip 15 by the position correction magnetic force from the front surface side of the metal strip 15.

In the present embodiment, a circuit configuration of each of the electromagnets 4*a* (refer to FIG. 2) of the back surface side electromagnet group 4 is the same as a configuration obtained by replacing the amplifier 10*a* in the circuit configuration of each of the electromagnets 3*a* illustrated in FIG. 4 with one of the plurality of amplifiers constituting the amplifier unit 12 (refer to FIG. 1) for vibration suppression, supplying power to the back surface side electromagnet group 4, and replacing the amplifier 11*a* with one of the plurality of amplifiers constituting the amplifier unit 13 (refer to FIG. 1) for position correction, supplying power to the back surface side electromagnet group 4.

Each of the electromagnets 4*a* having the above circuit configuration causes a vibration suppression magnetic force by the vibration suppression coil 17 to act on a back surface side of the metal strip 15, and thereby suppresses vibration of the metal strip 15 by the vibration suppression magnetic force from the back surface side of the metal strip 15. In addition, each of the electromagnets 4*a* causes a position correction magnetic force by the position correction coil 18 to act on a back surface side of the metal strip 15, and thereby corrects a position of the metal strip 15 by the position correction magnetic force from the back surface side of the metal strip 15.

(Basic Principle)

Next, a basic principle of the present invention, specifically, a relationship between the number of turns of a coil in an electromagnet, and response of the electromagnet and an attractive force thereof will be described. In general, an action of an electromagnet constituted by winding a coil about a core is represented by the following equation in formula (1) using an applied voltage e, a current i flowing in a coil, an inductance L of the coil, a resistance R of the coil, and time t.

$$e=L\times(di/dt)+R\times i \tag{1}$$

As illustrated in formula (1), in the action of the electromagnet, the current i flowing in a coil has a first-order delay system with respect to the applied voltage e. At that time, a time constant T is represented by the following formula (2).

$$T=L/R \tag{2}$$

Here, the inductance L of a coil is proportional to a square of the number N of turns of the coil. A resistance R of a coil is proportional to the number N of turns of the coil. Therefore, the time constant T is proportional to the number N of turns of the coil based on formula (2). This means that the time constant T is increased as the number N of turns of the coil is increased and quick response of an electromagnet is reduced consequently.

Meanwhile, a magnetic attractive force F of an electromagnet is proportional to a square of the number N of turns of a coil and a square of the current i flowing in a coil, as represented by the following formula (3).

$$F\propto N^2\times i^2 \tag{3}$$

Therefore, it is advantageous to increase the number N of turns of a coil such that an electromagnet obtains a large attractive force F by the same current i.

In the embodiment of the present invention, as exemplified by each of the electromagnets 3*a* illustrated in FIG. 3, each electromagnet in the electromagnet unit 2 is constituted by concentrically winding the two independent lines of the vibration suppression coil 17 and the position correction coil 18 about the core 19 at the different number of turns from each other. In such an electromagnet including the concentrical coils formed of the vibration suppression coil 17 and the position correction coil 18, it is necessary to consider mutual induction between the two coils of the vibration suppression coil 17 and the position correction coil 18.

An induced electromotive force $e_1$ generated in the vibration suppression coil 17 and an induced electromotive force $e_2$ generated in the position correction coil 18 are represented by the following formulae (4) and (5) using a current $i_1$ flowing in the vibration suppression coil 17, a current $i_2$ flowing in the position correction coil 18, a mutual inductance M between the vibration suppression coil 17 and the position correction coil 18, and time t.

$$e_1=-M\times(di_2/dt) \quad (4)$$

$$e_2=-M\times(di_1/dt) \quad (5)$$

The mutual inductance M is represented by the following formula (6) using a coefficient k determined by shapes of the vibration suppression coil 17 and the position correction coil 18 and a mutual position thereof, an inductance $L_1$ of the vibration suppression coil 17, and an inductance $L_2$ of the position correction coil 18.

$$M=k\times\sqrt{(L_1\times L_2)} \quad (6)$$

In an embodiment of the present invention, a static current (excitation current) for position correction of the metal strip 15 flows in the position correction coil 18. Therefore, time change of this current $di_2/dt$ is approximately zero. Therefore, as the above formula (4) indicates, the vibration suppression coil 17 hardly generates the induced electromotive force $e_1$. Therefore, a current for position correction flowing in the position correction coil 18 has little influence on controlling vibration suppression of the metal strip 15 by the vibration suppression coil 17.

Meanwhile, a dynamic current (excitation current) for vibration suppression of the metal strip 15 flows in the vibration suppression coil 17. Therefore, time change of this current $di_1/dt$ is large. Therefore, as the above formula (5) indicates, the position correction coil 18 generates the large induced electromotive force $e_2$.

When the induced electromotive force $e_2$ is generated in the position correction coil 18, a dynamic current flows in the position correction coil 18 for originally performing static control of position correction of the metal strip 15. Due to this phenomenon, vibration suppression of the metal strip 15 by the vibration suppression coil 17 is inhibited. Therefore, in order that each electromagnet in the electromagnet unit 2 may obtain a high vibration suppression ability of the metal strip 15, it is desirable to reduce the mutual inductance M so as to prevent an influence of mutual induction between the vibration suppression coil 17 and the position correction coil 18 from becoming excessively large.

The mutual inductance M is represented by the following formula (7) using a ratio $N_2/N_1$ of the number of turns of coils between the vibration suppression coil 17 and the position correction coil 18 and the total number Ns of turns of a coil because the inductance L of a coil is proportional to a square of the number N of turns of a coil.

$$M=k'\times Ns^2\times\alpha/(1+\alpha)^2 \quad (7)$$

The ratio $N_2/N_1$ of the number of turns of coils is a ratio of the number $N_2$ of turns of the position correction coil 18 with respect to the number $N_1$ of turns of the vibration suppression coil 17, and is assumed to be $\alpha$ in formula (7). The total number Ns of turns of a coil is a sum of the number $N_1$ of turns of the vibration suppression coil 17 and the number $N_2$ of turns of the position correction coil 18 for each core. A coefficient k' is determined by shapes of the vibration suppression coil 17 and the position correction coil 18 and a mutual position thereof, and a shape of the core 19 and a material thereof.

Figure 5:
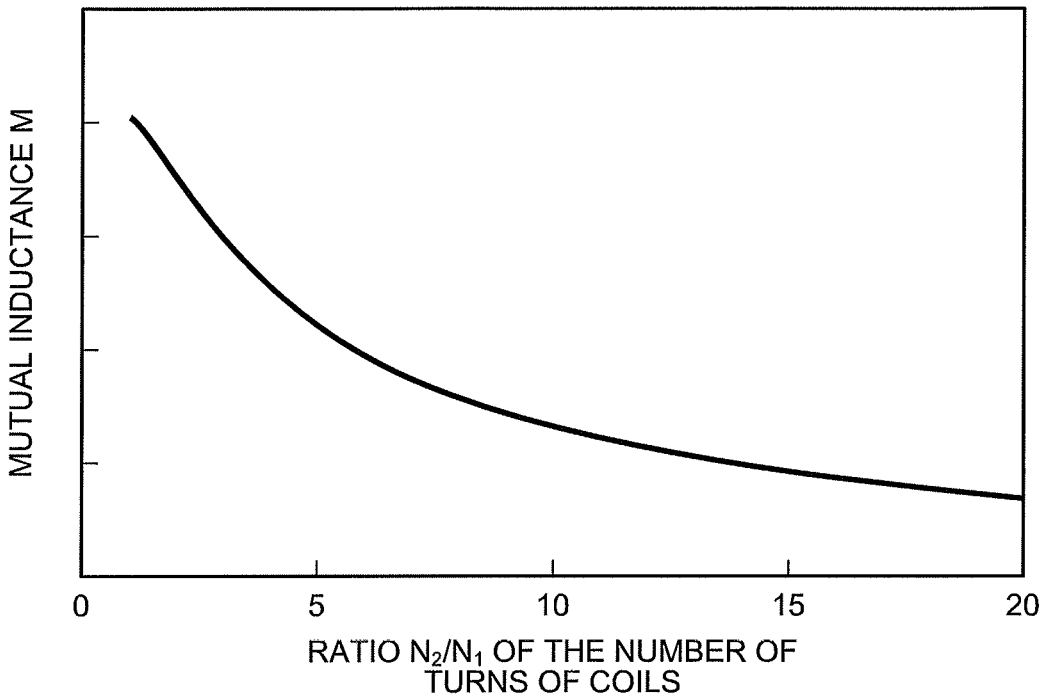
FIG. 5 is a diagram illustrating a relationship between a ratio of the number of turns between a vibration suppression coil and a position correction coil, and a mutual inductance.

FIG. 5 is a diagram illustrating a relationship between a ratio of the number of turns of coils between a vibration suppression coil and a position correction coil, and mutual inductance. When the total number Ns of turns of the vibration suppression coil 17 and the position correction coil 18 is constant, the mutual inductance M between the vibration suppression coil 17 and the position correction coil 18 is changed according the ratio $N_2/N_1$ of the number of turns of these coils. Specifically, as illustrated in FIG. 5, the mutual inductance M is reduced as the ratio $N_2/N_1$ of the number of turns of coils is increased. That is, the mutual inductance M is reduced as the number $N_2$ of turns of the position correction coil 18 is increased with respect to the number $N_1$ of turns of the vibration suppression coil 17. By reducing the mutual inductance M, an influence of mutual induction between the vibration suppression coil 17 and the position correction coil 18 can be reduced.

Meanwhile, the attractive force F of an electromagnet is proportional to a square of the number N of turns of a coil, as illustrated in the above formula (3). Therefore, when the number $N_1$ of turns of the vibration suppression coil 17 is different from the number $N_2$ of turns of the position correction coil 18, an attractive force $F_1$ of the vibration suppression coil 17 is changed according the ratio $N_2/N_1$ of the number of turns of coils between the vibration suppression coil 17 and the position correction coil 18. In an embodiment of the present invention, the attractive force $F_1$ of the vibration suppression coil 17 is an attractive force for vibration suppression of the metal strip 15 by a vibration suppression magnetic force generated by the vibration suppression coil 17.

Figure 6:
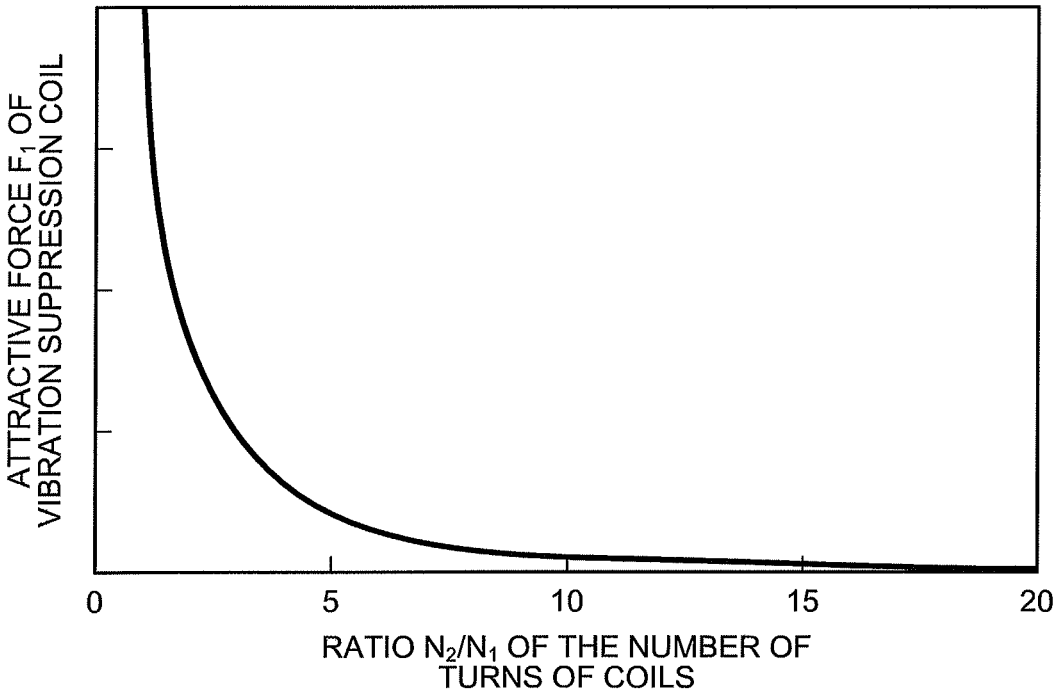
FIG. 6 is a diagram illustrating a relationship between a ratio of the number of turns between a vibration suppression coil and a position correction coil, and an attractive force of the vibration suppression coil.

FIG. 6 is a diagram illustrating a relationship between a ratio of the number of turns between a vibration suppression coil and a position correction coil, and an attractive force of the vibration suppression coil. When the total number Ns of turns of the vibration suppression coil 17 and the position correction coil 18 is constant, as illustrated in FIG. 6, the attractive force $F_1$ of the vibration suppression coil 17 is reduced as the ratio $N_2/N_1$ of the number of turns of coils between the vibration suppression coil 17 and the position correction coil 18 is increased. That is, the attractive force $F_1$ of the vibration suppression coil 17 is reduced as the number $N_2$ of turns of the position correction coil 18 is increased with respect to the number $N_1$ of turns of the vibration suppression coil 17.

In an embodiment of the present invention, the attractive force $F_1$ of the vibration suppression coil 17 is not required to be as large as an attractive force $F_2$ of the position correction coil 18. However, when the attractive force $F_1$ is excessively small, vibration of the metal strip 15 cannot be suppressed by the attractive force $F_1$. Therefore, it is necessary to design the ratio $N_2/N_1$ of the number of turns of coils between the vibration suppression coil 17 and the position correction coil 18 so as to secure the attractive force $F_1$ required for vibration suppression of the metal strip 15. Note that the attractive force $F_2$ of the position correction coil 18 is an attractive force for position correction of the metal strip 15 by a position correction magnetic force generated by the position correction coil 18.

As described above, in order to increase a vibration suppression ability of the metal strip 15 by each electromagnet of the electromagnet unit 2, it is desirable to increase the ratio $N_2/N_1$ of the number of turns of coils between the vibration suppression coil 17 and the position correction coil 18, reduce the mutual inductance M therebetween, and thereby make an influence of mutual induction between the vibration suppression coil 17 and the position correction coil 18 as small as possible. Meanwhile, in order to secure the attractive force $F_1$ of the vibration suppression coil 17 required for vibration suppression of the metal strip 15, it is desirable to reduce the ratio $N_2/N_1$ of the number of turns of coils and increase the attractive force $F_1$. However, when the ratio $N_2/N_1$ of the number of turns of coils is too small, the attractive force $F_2$ of the position correction coil 18 required for position correction of the metal strip 15 cannot be secured, and a position correction ability of the metal strip 15 by each electromagnet of the electromagnet unit 2 becomes excessively small.

Therefore, the ratio $N_2/N_1$ of the number of turns of coils is set so as to secure the attractive force $F_1$ required for vibration suppression of the metal strip 15 and the attractive force $F_2$ required for position correction of the metal strip 15 and to set the mutual inductance M capable of making an influence of mutual induction between the coils, inhibiting vibration suppression of the metal strip 15 as small as possible. Specifically, in an embodiment of the present invention, the ratio $N_2/N_1$ of the number of turns of coils is set to two or more and five or less, and preferably to three or more and four or less. That is, the number $N_2$ of turns of the position correction coil 18 is twice or more to five times or less of the number $N_1$ of turns of the vibration suppression coil 17, preferably in a range of three times or more and four times or less the number $N_1$ of turns of the vibration suppression coil 17. A vibration characteristic of the metal strip 15 and rigidity thereof are changed according to an operation condition such as a width of the metal strip 15, a thickness thereof, or a tension thereof. However, a balance among the abilities required for the vibration suppression coil 17 and the position correction coil 18 is not changed. Therefore, a preferable range of the ratio $N_2/N_1$ of the number of turns of coils between the vibration suppression coil 17 and the position correction coil 18 is not changed according to an operation condition.

(Hot-Dip Coated Metal Strip Manufacturing Line)

Figure 7:
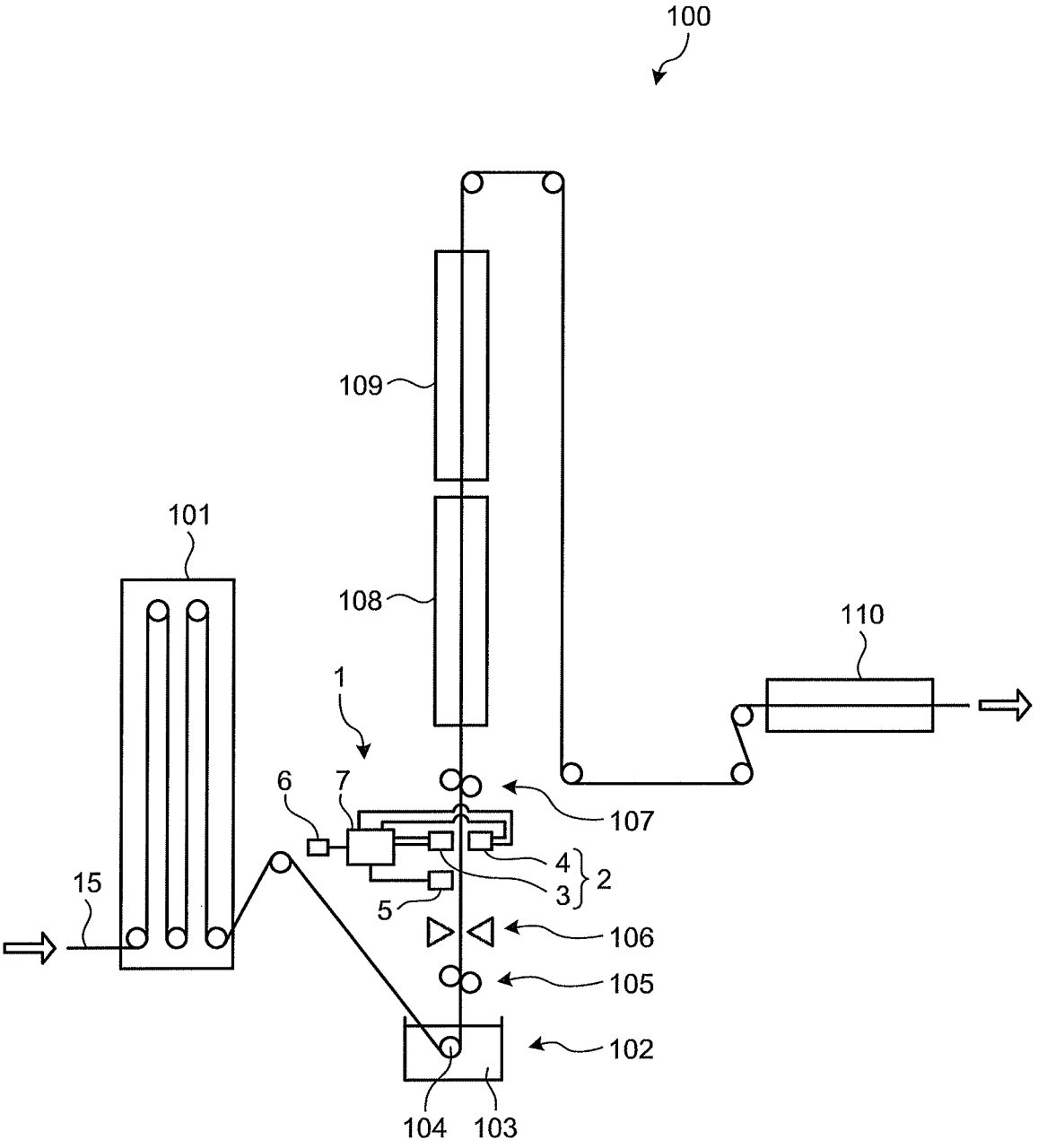
FIG. 7 is a diagram illustrating a configuration example of a hot-dip coated metal strip manufacturing line according to an embodiment of the present invention.
Figure 8:
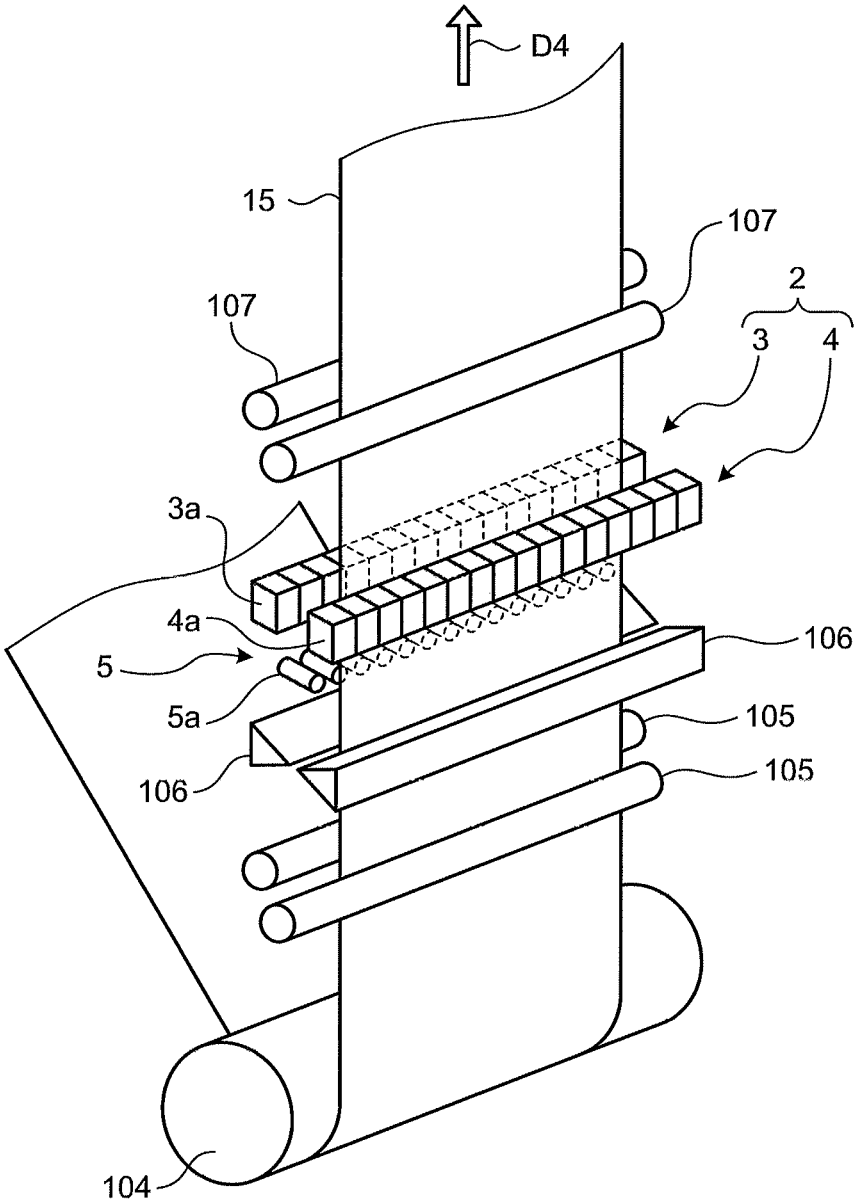
FIG. 8 is an enlarged view illustrating the vicinity of a gas wiper in the hot-dip coated metal strip manufacturing line according to an embodiment of the present invention.

Next, a hot-dip coated metal strip manufacturing line to which the metal strip stabilization apparatus 1 according to an embodiment of the present invention is applied will be described. FIG. 7 is a diagram illustrating a configuration example of a hot-dip coated metal strip manufacturing line according to an embodiment of the present invention. FIG. 8 is an enlarged view illustrating the vicinity of a gas wiper in the hot-dip coated metal strip manufacturing line according to an embodiment of the present invention.

A hot-dip coated metal strip manufacturing line 100 according to an embodiment of the present invention manufactures a hot-dip coated metal strip by subjecting the metal strip 15 traveling continuously to a molten metal plating treatment. The metal strip stabilization apparatus 1 according to an embodiment of the present invention is applied to the manufacturing line 100.

Specifically, as illustrated in FIG. 7, the manufacturing line 100 includes an annealing furnace 101, a molten metal bath 102, a pull-in roller 104, pull-up rollers 105 and 107, a gas wiper 106, an alloying furnace 108, a cooling strip 109, and a chemical treatment unit 110. In addition, as illustrated in FIG. 7, the manufacturing line 100 includes the metal strip stabilization apparatus 1 between the gas wiper 106 and the pull-up roller 107.

The annealing furnace 101 performs an annealing treatment to the metal strip 15 traveling continuously. As illustrated in FIG. 7, the annealing furnace 101 is disposed on an upstream side of the molten metal bath 102 on a traveling route of the metal strip 15. An inside of the annealing furnace 101 is maintained in a non-oxidizing or reducing of atmosphere. The molten metal bath 102 coats the metal strip 15 with a molten metal 103 after an annealing treatment by the annealing furnace 101. As illustrated in FIG. 7, the molten metal bath 102 houses the molten metal 103, and is disposed on a downstream side of the annealing furnace 101 on the traveling route of the metal strip 15.

The pull-in roller 104 sequentially pulls the metal strip 15 after the annealing treatment in the molten metal 103 housed in the molten metal bath 102. As illustrated in FIG. 7, the pull-in roller 104 is provided in the molten metal bath 102. The pull-up rollers 105 and 107 pull up the metal strip 15 coated with the molten metal 103 from the molten metal bath 102. As illustrated in FIGS. 7 and 8, each of the pull-up rollers 105 and 107 is constituted by using a pair of rotating roll bodies sandwiching the metal strip 15 from front and back surface sides thereof. One of the pull-up rollers 105 is disposed on a downstream side of the molten metal bath 102 and the pull-in roller 104 on the traveling route of the metal strip 15. The other of the pull-up rollers 107 is disposed between the gas wiper 106 and the alloying furnace 108, specifically, as illustrated in FIGS. 7 and 8, on a downstream side of the electromagnet unit 2 in the metal strip stabilization apparatus 1 on the traveling route of the metal strip 15.

The gas wiper 106 adjusts the coating amount of a molten metal on front and back surfaces of the metal strip 15 by ejecting a wiping gas to the front and back surfaces of the metal strip 15. As illustrated in FIGS. 7 and 8, the gas wiper 106 is disposed near the traveling route of the metal strip 15 pulled up by the pull-up rollers 105 and 107, specifically, between the pull-up roller 105 on a lower side and the electromagnet unit 2 of the metal strip stabilization apparatus 1. The wiping gas is a gas for wiping an excessive portion of the molten metal coating front and back surfaces of the metal strip 15.

As illustrated in FIG. 7, the metal strip stabilization apparatus 1 is disposed between the gas wiper 106 and the pull-up roller 107 on an upper side. Specifically, as illustrated in FIG. 8, the non-contact displacement sensors 5*a* of the displacement measurement unit 5 in the metal strip stabilization apparatus 1 are disposed between the gas wiper 106 and the electromagnet unit 2 (for example, each of the electromagnets 3*a* of the front surface side electromagnet group 3) so as to be arranged in the width direction D2 (refer to FIG. 2) of the metal strip 15. The electromagnet unit 2 is disposed between the displacement measurement unit 5 and the pull-up roller 107 on an upper side. At this time, as illustrated in FIG. 8, the electromagnets 3*a* of the front surface side electromagnet group 3 and the electromagnets 4*a* of the back surface side electromagnet group 4 are disposed so as to face each other with the metal strip 15 sequentially traveling toward the traveling direction D4 interposed therebetween and to be arranged in the width direction D2 (refer to FIG. 2) of the metal strip 15. Meanwhile, the input unit 6 of the metal strip stabilization apparatus 1 and the control unit 7 thereof are disposed at appropriate positions in the manufacturing line 100.

The alloying furnace 108 performs an alloying treatment for forming a uniform alloy layer to the metal strip 15 after coating a molten metal. As illustrated in FIG. 7, the alloying furnace 108 is disposed between the pull-up roller 107 on an upper side and the cooling strip 109. The cooling strip 109 cools the metal strip 15 after the alloying treatment. As illustrated in FIG. 7, the cooling strip 109 is disposed on a downstream side of the alloying furnace 108 on the traveling route of the metal strip 15. The chemical treatment unit 110 performs a special surface treatment such as a rustproofing treatment or an anti-corrosion treatment to the metal strip 15 after the alloying treatment and the cooling treatment. As illustrated in FIG. 7, the chemical treatment unit 110 is disposed on a downstream side of the cooling strip 109 on the traveling route of the metal strip 15.

(Method for Manufacturing Hot-Dip Coated Metal Strip)

Next, a method for manufacturing a hot-dip coated metal strip according to an embodiment of the present invention will be described with reference to FIGS. 7 and 8. In the method for manufacturing a hot-dip coated metal strip according to an embodiment of the present invention, while the metal strip stabilization apparatus 1 performs vibration suppression and position correction for the metal strip 15 during traveling along the manufacturing line 100, a hot-dip coated metal strip is sequentially manufactured from the metal strip 15 by the manufacturing line 100.

Specifically, in the manufacturing line 100 illustrated in FIG. 7, first, the metal strip 15 is subjected to an annealing treatment by the annealing furnace 101 (annealing step). In this annealing step, the annealing furnace 101 sequentially performs an annealing treatment to the metal strip 15 during traveling while the metal strip 15 sequentially conveyed from a preceding step such as a cold rolling process travels continuously. Subsequently, the annealing furnace 101 sequentially sends the metal strip 15 after the annealing treatment toward the molten metal bath 102.

After the annealing step, the metal strip 15 travels from the annealing furnace 101 toward the molten metal bath 102, and a coating step of coating the metal strip 15 with the molten metal 103 is performed. In this coating step, the pull-in roller 104 sequentially pulls the metal strip 15 sent from the annealing furnace 101 in the molten metal 103 of the molten metal bath 102. The pull-in roller 104 thereby sequentially immerses the metal strip 15 in the molten metal 103 while the metal strip 15 travels. The molten metal bath 102 sequentially receives the metal strip 15 during traveling in the molten metal 103 along the manufacturing line 100 by an action of the pull-in roller 104, and coats front and back surfaces of the metal strip 15 with the molten metal 103 during traveling.

After the coating step, the metal strip 15 is sequentially pulled up from the molten metal 103 of the molten metal bath 102 by the pull-up rollers 105 and 107, and sequentially travels toward the gas wiper 106. An adjustment step of adjusting the coating amount of a molten metal in the metal strip 15 is performed to the metal strip 15 during traveling by wiping an excessive portion of the molten metal coating the metal strip 15 by the gas wiper 106.

In this adjustment step, the gas wiper 106 ejects a wiping gas continuously to the entire area of the front and back surfaces of the metal strip 15 sequentially pulled up from the molten metal bath 102. By the ejection of the wiping gas, the gas wiper 106 wipes an excessive portion of the molten metal from front and back surfaces of the metal strip 15, and adjusts the coating amount of the molten metal on the front and back surfaces of the metal strip 15 to an appropriate amount.

The metal strip 15 after adjustment of the coating amount of the molten metal is subjected to vibration suppression and position correction by the metal strip stabilization apparatus 1 (control step) while sequentially traveling in the traveling direction D4 (refer to FIG. 8) by an action of the pull-up roller 107 or the like.

In this control step, as illustrated in FIG. 8, the non-contact displacement sensors 5*a* of the displacement measurement unit 5 sequentially measure a displacement of the metal strip 15 during traveling from an outlet side of the gas wiper 106 in the traveling direction D4 (for example, upper vertical direction) from the reference traveling route. The control unit 7 generates a vibration suppression signal and a position correction signal based on a deviation signal between a measurement value of a displacement of the metal strip 15 by each of the non-contact displacement sensors 5*a* and a target value of a displacement input by the input unit 6. Subsequently, the control unit 7 controls the electromagnet unit 2 based on the generated vibration suppression signal and position correction signal.

The electromagnet unit 2 causes a vibration suppression magnetic force and a position correction magnetic force to act on the front and back surfaces of the metal strip 15 during traveling based on control of the control unit 7, and thereby controls vibration of the metal strip 15 and a position thereof in a non-contact manner. At this time, as described above, the electromagnets 3*a* of the front surface side electromagnet group 3 illustrated in FIG. 8 cause a vibration suppression magnetic force and a position correction magnetic force generated by the vibration suppression coil 17 and the position correction coil 18 (refer to FIG. 3), respectively, having the ratio $N_2/N_1$ of the number of turns of coils of two or more and five or less to act on a front surface side of the metal strip 15 during traveling. The electromagnets 3*a* suppress vibration of the metal strip 15 by the attractive force $F_1$ based on the vibration suppression magnetic force from the front surface side of the metal strip 15, and corrects a position of the metal strip 15 by the attractive force $F_2$ based on the position correction magnetic force.

In parallel to this, as described above, the electromagnets 4*a* of the back surface side electromagnet group 4 illustrated in FIG. 8 cause a vibration suppression magnetic force and a position correction magnetic force generated by the vibration suppression coil 17 and the position correction coil 18 (refer to FIG. 3), respectively, having the ratio $N_2/N_1$ of the number of turns of coils of two or more and five or less to act on a back surface side of the metal strip 15 during traveling. The electromagnets 4*a* suppress vibration of the metal strip 15 by the attractive force $F_1$ based on the vibration suppression magnetic force from the back surface side of the metal strip 15, and corrects a position of the metal strip 15 by the attractive force $F_2$ based on the position correction magnetic force.

As described above, the electromagnets 3*a* and 4*a* of the electromagnet unit 2 control vibration suppression and position correction of a series of the metal strips 15 continuous between the position of the gas wiper 106 and a position of each of the electromagnets 3*a* and 4*a* by performing vibration suppression and position correction by the attractive forces $F_1$ and $F_2$ of the metal strip 15 during traveling. By this control, a portion at least facing the gas wiper 106 in the metal strip 15 is subjected to vibration suppression and position correction. As a result, a pass line in the portion facing the gas wiper 106 in the metal strip 15 is stabilized along the reference traveling route. Therefore, a gap between the gas wiper 106 and each of the front and back surfaces of the metal strip 15 during traveling is constant. In this state, a pressure of the wiping gas ejected to the metal strip 15 during traveling from the gas wiper 106 is uniform on each of the front and back surfaces of the metal strip 15. As a result, it is possible to suppress unevenness in the coating amount of the molten metal on each of the front and back surfaces of the metal strip 15.

After the above control step, the metal strip 15 is subjected to an alloying treatment by the alloying furnace 108 while traveling along the manufacturing line 100 (alloying treatment step). In this alloying treatment step, as described above, the alloying furnace 108 sequentially receives the metal strip 15 after adjustment of the coating amount of the molten metal, heats the received metal strip 15 again, and thereby forms a uniform alloy layer on each of the front and back surfaces of the metal strip 15.

After the alloying treatment step, the metal strip 15 is sent to an outlet side of the alloying furnace 108. The metal strip 15 after the alloying treatment is cooled by the cooling strip 109 while traveling in the cooling strip 109 (cooling step). After the cooling step, the metal strip 15 travels from the cooling strip 109 toward the chemical treatment unit 110, and is subjected to a necessary chemical treatment by the chemical treatment unit 110 (chemical treatment step). In this chemical treatment step, the chemical treatment unit 110 performs a special rustproofing treatment and anti-corrosion treatment to the metal strip 15 after cooling. The metal strip 15 after the chemical treatment is sent to an outlet side of the chemical treatment unit 110, and is then wound into a coil shape as a hot-dip coated metal strip manufactured by the manufacturing line 100 to be shipped.

The above alloying treatment step and chemical treatment step are performed appropriately according to an application of the metal strip 15 such as use of a hot-dip coated metal strip manufactured based on the metal strip 15 as an external plate for an automobile. Therefore, the manufacturing line 100 may include the alloying furnace 108 and the chemical treatment unit 110, and does not have to include the alloying furnace 108 or the chemical treatment unit 110 according to an application of the metal strip 15.

Example

Next, an Example of the present invention will be described. As illustrated in FIG. 7, this Example specifically verifies effects of vibration suppression and position correction of the metal strip 15 during traveling along the manufacturing line 100 using the metal strip stabilization apparatus 1 applied to the hot-dip coated metal strip manufacturing line 100. That is, in this Example, a verification test for verifying an effect of the metal strip stabilization apparatus 1 is performed, and a vibration suppression ability of the metal strip 15 during traveling by the metal strip stabilization apparatus 1 and a position correction ability thereof are thereby evaluated. Hereinafter, the vibration suppression ability means an ability for the metal strip stabilization apparatus 1 to suppress vibration of the metal strip 15 during traveling by a vibration suppression magnetic force. Hereinafter, the position correction ability means an ability for the metal strip stabilization apparatus 1 to correct a position of the metal strip 15 during traveling by a position correction magnetic force.

In the verification test performed in this Example, in each of the electromagnets 3*a* and 4*a* constituting the electromagnet unit 2 of the metal strip stabilization apparatus 1, the total number Ns of turns of the vibration suppression coil 17 and the position correction coil 18 (refer to FIGS. 3 and 4) was constant. By changing the ratio $N_2/N_1$ of the number of turns of coils between the vibration suppression coil 17 and the position correction coil 18 under this condition, a vibration suppression ability of the metal strip stabilization apparatus 1 and a position correction ability thereof were measured.

Figure 9:
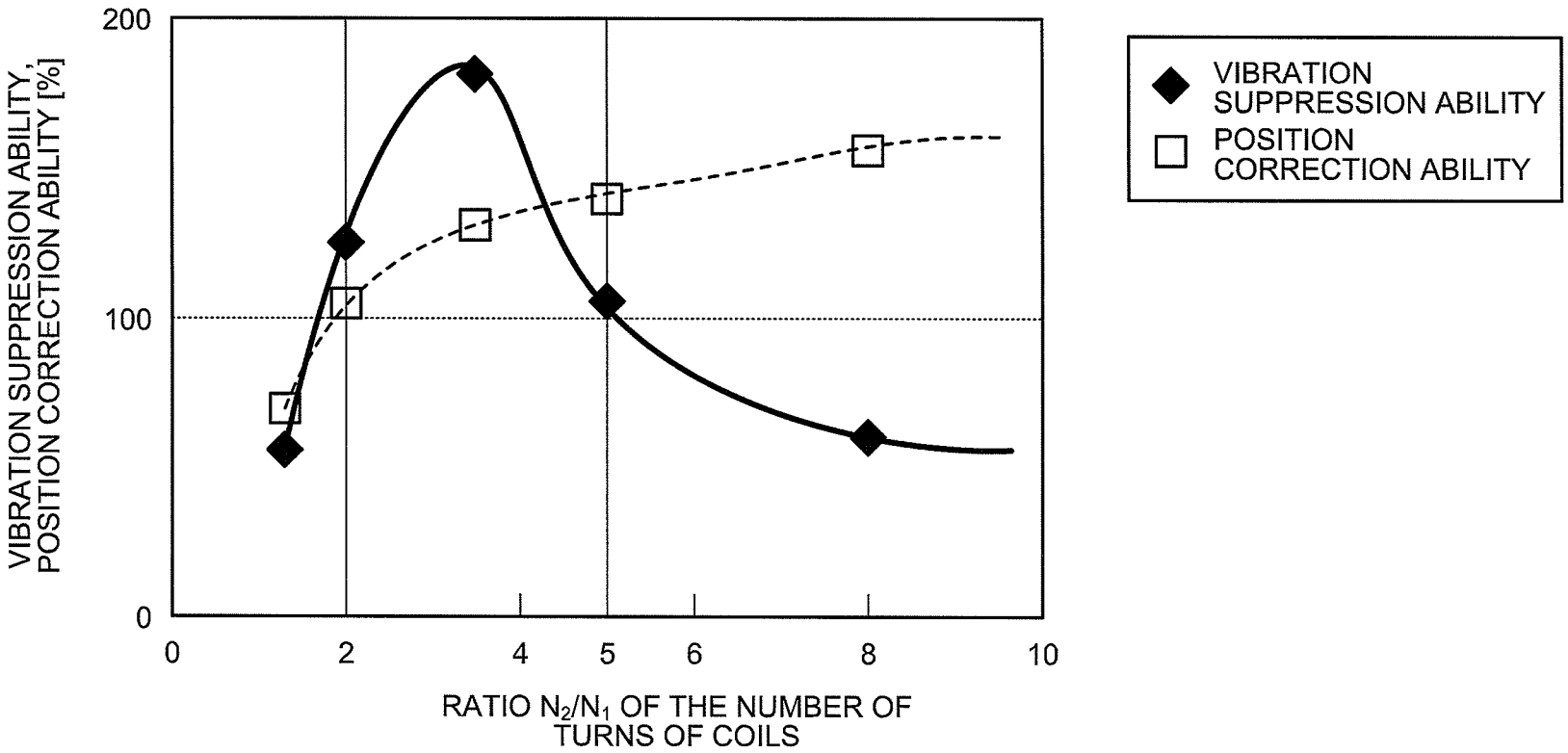
FIG. 9 is a diagram illustrating an example of a result of a verification test for verifying an effect of the metal strip stabilization apparatus according to an embodiment of the present invention.

FIG. 9 is a diagram illustrating an example of a result of a verification test for verifying an effect of the metal strip stabilization apparatus according to an embodiment of the present invention. In FIG. 9, each of target values of a vibration suppression ability of an evaluation target and a position correction ability thereof was set to 100[%], and plotting was performed so as to indicate a correlation between relative measurement data of the abilities with respect to the set target value and the ratio $N_2/N_1$ of the number of turns of coils. At this time, the measurement data of the vibration suppression ability with respect to the ratio $N_2/N_1$ of the number of turns of coils was plotted using the mark ◆. The measurement data of the position correction ability with respect to the ratio $N_2/N_1$ of the number of turns of coils was plotted using the mark □.

In this Example, the vibration suppression ability was evaluated by a reduction ratio of a vibration amplitude of the metal strip 15 when a vibration suppression magnetic force from the vibration suppression coil 17 acted on the metal strip 15 during traveling. The position correction ability was evaluated by a displacement amount of the metal strip 15 (for example, warp correction amount and pass line correction amount) in which correction was possible when a position correction magnetic force from the position correction coil 18 acted on the metal strip 15 during traveling. Each of target values of the vibration suppression ability and the position correction ability was determined by the degree of unevenness in the coating amount of the molten metal, allowable for the metal strip 15 used for manufacturing the hot-dip coated metal strip. That is, 100[%] of each of the vibration suppression ability and the position correction ability means a level capable of suppressing unevenness in the coating amount of the molten metal in the metal strip 15 within an allowable range. In addition, 100[%] or more of each of the vibration suppression ability and the position correction ability means a level capable of further suppressing vibration of the metal strip 15, further correcting a position of the metal strip 15, and more securely suppressing unevenness in the coating amount of the molten metal in the metal strip 15 within an allowable range.

As illustrated in FIG. 9, the vibration suppression ability was as small as less than the target value (=100[%]) in a range in which the ratio $N_2/N_1$ of the number of turns of coils was more than five or less than two. A reason why such a verification test result was obtained is as follows. That is, when the ratio $N_2/N_1$ of the number of turns of coils was more than five, the attractive force $F_1$ (refer to FIG. 6) by a vibration suppression magnetic force from the vibration suppression coil 17 was excessively small. As a result, the vibration suppression magnetic force could not perform vibration suppression of the metal strip 15, and therefore the vibration suppression ability was less than the target value. When the ratio $N_2/N_1$ of the number of turns of coils was less than two, the mutual inductance M (refer to FIG. 5) between the vibration suppression coil 17 and the position correction coil 18 was excessively large. As a result, vibration suppression of the metal strip 15 by the vibration suppression magnetic force was inhibited due to an influence of mutual induction between the coils, and therefore the vibration suppression ability was less than the target value.

Meanwhile, as illustrated in FIG. 9, the position correction ability was increased in accordance with increase in the ratio $N_2/N_1$ of the number of turns of coils, and was equal to or more than the target value (=100[%]) when the ratio $N_2/N_1$ of the number of turns of coils was two or more. This verification test result was obtained because the attractive force $F_2$ by the position correction magnetic force of the position correction coil 18 was increased in accordance with increase in the number $N_2$ of turns of the position correction coil 18 and the position correction amount of the metal strip 15 by the position correction magnetic force could be increased.

From the above verification test result, as clear by referring to FIG. 9, it has been found that it is necessary to set the ratio $N_2/N_1$ of the number of turns of coils to a range of two or more and five or less, preferably to a range of three or more and four or less in order to cause the metal strip 15 during traveling to exhibit both the vibration suppression ability and the position correction ability simultaneously. That is, the number $N_2$ of turns of the position correction coil 18 required for achieving the vibration suppression ability and the position correction ability simultaneously is in a range of twice or more to five times or less of the number $N_1$ of turns of the vibration suppression coil 17, preferably in a range of three times or more and four times or less the number $N_1$.

As described above, the metal strip stabilization apparatus according to an embodiment of the present invention constitutes an electromagnet unit by winding a vibration suppression coil and a position correction coil about a core concentrically such that the number of turns of the position correction coil is in a range of twice or more to five times or less of the number of turns of the vibration suppression coil, generates a vibration suppression signal and a position correction signal based on a measurement signal obtained by measuring a displacement of a metal strip during traveling in a non-contact manner, causes the vibration suppression coil of the electromagnet unit to generate a vibration suppression magnetic force based on the vibration suppression signal, suppresses vibration of the metal strip during traveling by the vibration suppression magnetic force and causes the position correction coil of the electromagnet unit to generate a position correction magnetic force based on the position correction signal simultaneously, and corrects a position of the metal strip during traveling by the position correction magnetic force.

Therefore, it is possible to secure an attractive force of a vibration suppression magnetic force required for vibration suppression of a metal strip during traveling and an attractive force of a position correction magnetic force required for position correction of the metal strip simultaneously, and to make an influence of mutual induction between a vibration suppression coil and a position correction coil, inhibiting vibration suppression of the metal strip as small as possible. This allows an attractive force of the vibration suppression magnetic force sufficient for vibration suppression and an attractive force of the position correction magnetic force sufficient for position correction to act on the metal strip during traveling simultaneously. As a result, both a required vibration suppression ability of a metal strip and a required position correction ability thereof can be achieved simultaneously such that the metal strip travels stably. A pass line of the metal strip can be maintained stably by the vibration suppression ability and the position correction ability.

In the method for manufacturing a hot-dip coated metal strip according to an embodiment of the present invention, a metal strip is coated with a molten metal during traveling along a manufacturing line, the coating amount of the molten metal in the metal strip is adjusted by wiping an excessive portion of the molten metal coating the metal strip by a gas wiper, and vibration of the metal strip and a position thereof are controlled in a non-contact manner by a vibration suppression magnetic force and a position correction magnetic force from the metal strip stabilization apparatus according to an embodiment of the invention.

Therefore, an action and an effect similar to the metal strip stabilization apparatus according to an embodiment of the invention can be received. In addition, vibration suppression and position correction for a series of metal strips continuous between an electromagnet unit and a gas wiper in this apparatus can be performed suitably in accordance with a reference traveling route. Vibration suppression and position correction for a portion of the metal strip facing the gas wiper in the metal strip during traveling after coating a molten metal can be thereby achieved. Therefore, a pass line of this portion of the metal strip can be stabilized along the reference traveling route. As a result, a gap between the metal strip during traveling after coating a molten metal and the gas wiper can be maintained constantly. Therefore, a pressure of a wiping gas from the gas wiper, applied to each of front and back surfaces of the metal strip can be uniform over an entire area of the metal strip. By unification of the pressure of the wiping gas, an excessive portion of the molten metal on the front and back surfaces of the metal strip can be wiped uniformly. As a result, unevenness in the coating amount of the molten metal on the front and back surfaces of the metal strip can be suppressed, and an excellent hot-dip coated metal strip can be manufactured.

In the above embodiment, the electromagnet unit 2 is constituted by the plurality of electromagnets 3*a* and 4*a* disposed on the front and back surfaces of the metal strip 15, respectively. However, the present invention is not limited thereto. In the present invention, the electromagnet unit 2 may be constituted by a single electromagnet unit or a plurality of electromagnets. In this case, an electromagnet constituting the electromagnet unit 2 may be disposed only on a front surface side of the metal strip 15, only on a back surface side thereof, or on both the front and back surface sides thereof. When the electromagnet unit 2 is constituted by a plurality of electromagnets, the plurality of electromagnets may face each other with the metal strip 15 interposed therebetween, and does not have to face each other. Meanwhile, the number of disposition of electromagnets constituting the electromagnet unit 2 may be set according to a width of the traveling metal strip 15 (length in the width direction D2).

In the above embodiment, the displacement measurement unit 5 is constituted by the plurality of non-contact displacement sensors 5*a* disposed on a front surface side of the metal strip 15. However, the present invention is not limited thereto. In the present invention, the displacement measurement unit 5 may be constituted by a single non-contact displacement sensor or a plurality of non-contact displacement sensors. In this case, a non-contact displacement sensor constituting the displacement measurement unit 5 may be disposed only on a front surface side of the metal strip 15, only on a back surface side thereof, or on both the front and back surface sides thereof. The non-contact displacement sensor constituting the displacement measurement unit 5 may be disposed on either an upstream side or a downstream side of the electromagnet unit 2 in the traveling direction D4 of the metal strip 15. Meanwhile, the number of disposition of non-contact displacement sensors constituting the displacement measurement unit 5 may be set according to a width of the traveling metal strip 15.

In addition, in the above embodiment, a case where the traveling direction D4 of the metal strip 15 to be treated is an upper vertical direction has been exemplified. However, the present invention is not limited thereto. In the present invention, the traveling direction D4 of the metal strip 15 may be any direction of an upper vertical direction, a lower vertical direction, an oblique direction, and a horizontal direction.

In the above embodiment, the metal strip stabilization apparatus 1 has been applied to the hot-dip coated metal strip manufacturing line 100. However, the present invention is not limited thereto. In the present invention, the manufacturing line to which the metal strip stabilization apparatus 1 is applied may be a line for manufacturing a hot-dip coated metal strip, or a line for manufacturing a metal strip other than the hot-dip coated metal strip.

In the above embodiment, the electromagnet unit 2 is constituted by an electromagnet having two leg portions. However, the present invention is not limited thereto. In the present invention, an electromagnet constituting the electromagnet unit 2 may have a single leg portion, two leg portions, or three or more leg portions.

The present invention is not limited by the above embodiments or Example, but the present invention includes a configuration obtained by combining the above constituent elements appropriately. In addition, the present invention includes all of another embodiment, Example, operation technology, and the like performed by a person skilled in the art or the like based on the above embodiments or Example.

As described above, the metal strip stabilization apparatus according to the present invention and the method for manufacturing a hot-dip coated metal strip using the metal strip stabilization apparatus are useful for a metal strip manufacturing line, and is suitable particularly for a hot-dip coated metal strip manufacturing line.

REFERENCE SIGNS LIST

1 METAL STRIP STABILIZATION APPARATUS
2 ELECTROMAGNET UNIT
3 FRONT SURFACE SIDE ELECTROMAGNET GROUP
3*a*, 4*a* ELECTROMAGNET
4 BACK SURFACE SIDE ELECTROMAGNET GROUP
5 DISPLACEMENT MEASUREMENT UNIT
5*a* NON-CONTACT DISPLACEMENT SENSOR
6 INPUT UNIT
7 CONTROL UNIT
8 ARITHMETIC PROCESSING UNIT
9*a*, 9*b* SIGNAL DISTRIBUTION UNIT
10, 11, 12, 13 AMPLIFIER UNIT
10*a*, 11*a* AMPLIFIER
15 METAL STRIP
17 VIBRATION SUPPRESSION COIL
18 POSITION CORRECTION COIL
19 CORE
100 MANUFACTURING LINE
101 ANNEALING FURNACE
102 MOLTEN METAL BATH
103 MOLTEN METAL
104 PULL-IN ROLLER
105, 107 PULL-UP ROLLER
106 GAS WIPER
108 ALLOYING FURNACE
109 COOLING STRIP
110 CHEMICAL TREATMENT UNIT
D1 LONGITUDINAL DIRECTION
D2 WIDTH DIRECTION
D3 THICKNESS DIRECTION
D4 TRAVELING DIRECTION

The invention claimed is:

1. A metal strip stabilization apparatus comprising:

a displacement measurement unit configured to measure a displacement of a metal strip during traveling in a non-contact manner;

a control unit configured to generate a vibration suppression signal for controlling vibration suppression of the metal strip and a position correction signal for controlling position correction of the metal strip based on a measurement signal of a displacement of the metal strip by the displacement measurement unit; and an electromagnet unit including:

a vibration suppression coil configured to generate a first magnetic force based on the vibration suppression signal by the control unit;

a position correction coil configured to generate a second magnetic force based on the position correction signal by the control unit; and a core about which the vibration suppression coil and the position correction coil are wound concentrically, the core leading the first magnetic force and the second magnetic force to the metal strip, the electromagnet unit being configured to suppress vibration of the metal strip by the first magnetic force, and correct a position of the metal strip by the second magnetic force, wherein the number of turns of the position correction coil is twice to five times of the number of turns of the vibration suppression coil, the vibration suppression coil is connected to an amplifier for vibration suppression in series, and the position correction coil is directly connected to an amplifier for position correction in series, the position correction coil forming part of a series circuit consisting of the position correction coil and a position correction amplifier.

2. The metal strip stabilization apparatus according to claim 1, wherein the electromagnet unit includes:

a front surface side electromagnet configured to suppress vibration of the metal strip by the first magnetic force and correct a position of the metal strip by the second magnetic force from a front surface side of the metal strip; and a back surface side electromagnet configured to suppress vibration of the metal strip by the first magnetic force and correct a position of the metal strip by the second magnetic force from a back surface side of the metal strip.

3. The metal strip stabilization apparatus according to claim 2, wherein the front surface side electromagnet and the back surface side electromagnet face each other with the metal strip interposed therebetween.

4. The metal strip stabilization apparatus according to claim 3, wherein a plurality of the front surface side electromagnets and a plurality of the back surface side electromagnets are disposed so as to be arranged in a width direction of the metal strip.

5. The metal strip stabilization apparatus according to claim 2, wherein a plurality of the front surface side electromagnets and a plurality of the back surface side electromagnets are disposed so as to be arranged in a width direction of the metal strip.

6. A method for manufacturing a hot-dip coated metal strip, comprising:

a coating step of coating a metal strip with a molten metal during traveling along a manufacturing line;

an adjustment step of adjusting the coating amount of the molten metal in the metal strip by wiping an excessive portion of the molten metal coating the metal strip by a gas wiper; and a control step of controlling vibration of the metal strip and a position thereof in a non-contact manner by the metal strip stabilization apparatus according to claim 1.

7. The method for manufacturing a hot-dip coated metal strip according to claim 6, wherein the electromagnet unit includes:

a front surface side electromagnet configured to suppress vibration of the metal strip by the first magnetic force and correct a position of the metal strip by the second magnetic force from a front surface side of the metal strip; and a back surface side electromagnet configured to suppress vibration of the metal strip by the first magnetic force and correct a position of the metal strip by the second magnetic force from a back surface side of the metal strip.

8. The method for manufacturing a hot-dip coated metal strip according to claim 7, wherein the front surface side electromagnet and the back surface side electromagnet face each other with the metal strip interposed therebetween.

9. The method for manufacturing a hot-dip coated metal strip according to claim 8, wherein a plurality of the front surface side electromagnets and a plurality of the back surface side electromagnets are disposed so as to be arranged in a width direction of the metal strip.

10. The method for manufacturing a hot-dip coated metal strip according to claim 7, wherein a plurality of the front surface side electromagnets and a plurality of the back surface side electromagnets are disposed so as to be arranged in a width direction of the metal strip.

* * * * *